US006390871B1

(12) United States Patent
Wickman et al.

(10) Patent No.: US 6,390,871 B1
(45) Date of Patent: May 21, 2002

(54) FUEL RESERVOIR MOUNTED TO A DRIVESHAFT HOUSING OF AN OUTBOARD MOTOR

(75) Inventors: Timothy P. Wickman, Fond du Lac; David C. Entringer, Wautoma; Ervin H. Voss, Jr., Princeton; Robert J. Hensel, Oshkosh, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/903,459

(22) Filed: Jul. 11, 2001

Related U.S. Application Data

(63) Continuation-in-part of application No. 09/800,796, filed on Mar. 7, 2001.

(51) Int. Cl.[7] ..... B63H 5/10
(52) U.S. Cl. ..... 440/88; 123/41.31
(58) Field of Search ..... 440/88; 123/41.31, 123/516, 509, 510

(56) References Cited

U.S. PATENT DOCUMENTS 3,835,822 A * 9/1974 Mickle et al. ..... 123/41.31
4,728,306 A * 3/1988 Schneider ..... 440/1
4,768,492 A * 9/1988 Widmer et al. ..... 123/541
4,848,283 A * 7/1989 Garms et al. ..... 123/73 AD
5,103,793 A 4/1992 Riese et al.
5,309,885 A 5/1994 Rawlings et al.
5,368,001 A 11/1994 Roche
5,375,578 A * 12/1994 Kato et al. ..... 123/516
5,389,245 A 2/1995 Jaeger et al.
5,404,858 A 4/1995 Kato
5,579,740 A 12/1996 Cotton et al.
5,797,378 A * 8/1998 Kato ..... 123/516
5,819,711 A 10/1998 Motose
5,908,020 A * 6/1999 Boutwell et al. ..... 123/541
5,984,743 A * 11/1999 Wada et al. ..... 440/88
6,170,470 B1 1/2001 Clarkson et al.
6,253,742 B1 7/2001 Wickman et al.

* cited by examiner

*Primary Examiner*—S. Joseph Morano
*Assistant Examiner*—Ajay Vasudeva
(74) *Attorney, Agent, or Firm*—William D. Lanyi

(57) ABSTRACT

A fuel system for a marine propulsion system includes a reservoir that defines a cavity in which first and second fuel pumps are disposed. The reservoir is mounted on the marine propulsion system at a location which causes the reservoir to be at least partially submerged within, and in thermal communication with, water in which the marine propulsion system is operated when a propulsor of the marine propulsion system is inactive. The first fuel pump is a lift pump which draws fuel from a fuel tank and pumps the fuel into the cavity of the reservoir. The second fuel pump is a high pressure pump which draws fuel from the cavity and pumps the fuel at a higher pressure to a fuel rail of an engine.

20 Claims, 3 Drawing Sheets

FUEL RESERVOIR MOUNTED TO A DRIVESHAFT HOUSING OF AN OUTBOARD MOTOR

CROSS REFERENCE TO RELATED APPLICATION

This application is a continuation-in-part of U.S. patent application Ser. No. 09/800,796 which was filed on Mar. 7, 2001.

BACKGROUND OF THE INVENTION

1. Field of the Invention

The present invention is generally related to a fuel system for a marine propulsion system and, more particularly, to a fuel system that provides a fuel reservoir in which two pumps, a lift pump and a high pressure pump, are housed and disposed within a volume of fuel stored in the fuel reservoir.

2. Description of the Prior Art

Many different types of fuel delivery systems are known to those skilled in the art for use with marine propulsion systems. Certain fuel delivery systems incorporate fuel vapor separators, which act as a reservoir and a mechanism for separating fuel vapor from liquid fuel.

U.S. Pat. No. 5,819,711, which issued to Motose on Oct. 13, 1998, describes a vapor separator for a fuel injected engine. The fuel injection system of an engine, and particularly an outboard motor, includes a fuel vapor separator that is disposed on one side of the throttle bodies at the front of the engine. The fuel vapor separator is comprised of a housing assembly having a cover plate in which an integral fuel inlet fitting, an integral fuel outlet fitting, an integral vent fitting and an integral fuel return fitting are formed. The fuel injectors for the engine are disposed on the opposite side of the throttle bodies from the fuel vapor separator and are supplied with fuel through a vertically extending fuel rail. The pressure regulator is positioned at the top of the fuel rail and the fuel rail is directly affixed to the throttle bodies.

U.S. Pat. No. 5,375,578 which issued to Kato et al on Dec. 27, 1994, describes a high pressure fuel feeding device for a fuel injection engine. The injection system for an outboard motor includes a vapor fuel separator that has a fuel chamber in which the supply of fuel is maintained by a float valve and an air chamber positioned above the fuel chamber and to one side of it and which communicates with the fuel chamber through a perforated member. A fuel media fills the air chamber and an atmospheric air inlet is provided to the air chamber. Fuel pressure and fuel regulator valves are disposed in the area to the side of the air chamber and regulate fuel and air pressure by dumping fuel and air back to the fuel and air chambers, respectively, through integral internal conduits. The regulating system includes an arrangement for regulating the fuel pressure so that it will be at least greater than the air pressure by a predetermined amount and also for precluding the delivery of air under pressure if fuel under pressure is not supplied.

U.S. Pat. No. 5,579,740, which issued to Cotton et al on Dec. 3, 1996, describes a fuel handling system. The system is intended for use with an internal combustion engine having a vapor separator for receiving fuel from a remote tank and a pump for delivering the fuel under high pressure to a fuel injector of the engine while providing vapor separation. The separator has an inlet for receiving fuel from the tank, an outlet for enabling fuel to be removed and delivered to the engine, at least one return for enabling fuel not used by the engine to be returned to the separator, and a vent for removing fuel vapor from a gas dome above a pool of liquid fuel within the separator. The inlet has a valve controlled by a float in the reservoir for admitting fuel to maintain the level of liquid fuel in the separator. To retard foaming and excessive vaporization of liquid fuel in the separator, the separator has a perforate baffle between any return and the liquid fuel pool.

U.S. Pat. No. 5,404,858, which issued to Kato on Apr. 11, 1995, describes a high pressure fuel feeding device for a fuel injection engine. An outboard motor is provided with a fuel injection system in which all of the major components of the fuel portion of the fuel/air injection system are contained within a sealed chamber having a fuel drain and the conduits that supply fuel to the fuel injectors are also contained within the fuel collecting conduits so that any fuel leaking will not escape to the atmosphere. In addition, the air pressure supplied to the fuel/air injectors is regulated and the air relieved for pressure regulation is returned to an air inlet device having a baffle for condensing any fuel in the regulated air and returning the condensed fuel to a vapor separator.

U.S. Pat. No. 5,389,245, which issued to Jaeger et al on Feb. 14, 1995, discloses a vapor separating unit for a fuel system. The vapor separating unit has particular application to a fuel system for a marine engine. The vapor separating unit includes a closed tank having a fuel inlet through which fuel is fed to the tank by a diaphragm pump. The liquid level in the tank is controlled by float-operated valve. An electric pump is located within the vapor separating tank and has an inlet disposed in the tank and an outlet connected to a fuel rail assembly of the engine. Excess fuel from the fuel rail assembly is conducted back to the upper end of the vapor separator tank. A vapor venting mechanism is incorporated in the tank to vent vapor from the tank.

U.S. Pat. No. 5,368,001, which issued to Roche on Nov. 29, 1994, describes a fuel handling system for an internal combustion engine which has a reservoir for receiving fuel under low pressure from a remote gas tank and a fuel pump for delivering the fuel under high pressure to a fuel injector of the engine while providing vapor separation. The reservoir has an inlet for receiving fuel from the tank, an outlet for removing fuel from the reservoir and delivering it to the engine, a fuel return for returning fuel not used by the engine, a drain for removing water, and a vapor vent for removing fuel vapors from a gas dome above the liquid within the reservoir. The inlet has a valve controlled by a float in the reservoir for admitting fuel to maintain the level of liquid in the reservoir so that the pump is supplied with fuel. To remove fuel, a fuel pickup is coupled to an inlet of the pump which has its outlet coupled to the reservoir outlet. The pickup has a diaphragm for filtering fuel entering the pump while preferably preventing the o admission of gas or water. Preferably, a water sensor in the reservoir provides an electrical signal when it is immersed in water so that the drain can be opened to remove the water, preferably before the pickup is immersed and fuel flow to the pump and engine is cut off.

U.S. Pat. No. 5,103,793, which issued to Riese et al on Apr. 14, 1992, discloses a vapor separator for an internal combustion engine. The vapor separator includes a bowl member and a cover member. A fuel pump is located in the internal cavity of the bowl member and has its inlet located in the lower portion of the bowl member cavity, for supplying fuel thereto. The fuel pump is secured in position within the bowl member by engagement of the cover member with the fuel pump. The cover member includes a mounting portion for mounting a water separating filter element to the vapor separator assembly. The cover member includes structure for routing fuel from the discharge of the water separating filter element to the interior of the bowl member internal cavity. A compact arrangement is thus provided for the vapor separator, the fuel pump, and the water separating filter, eliminating a number of hose connections between such components as well as facilitating assembly of the engine.

U.S. Pat. No. 5,309,885, which issued to Rawlings et al on May 10, 1994, describes a marine propulsion device including a fuel injected, four-cycle internal combustion engine. The internal combustion engine comprises an engine block including a combustion chamber, a fuel vapor separator, a fuel supply mechanism for introducing fuel to the combustion chamber, a conduit communicating between the fuel vapor separator and the fuel supply mechanism for introducing fuel, and a cooling jacket for cooling the fuel vapor separator.

U.S. Pat. No. 6,170,470 B 1, which issued to Clarkson et al on Jan. 9, 2001, discloses a fuel supply system for an internal combustion engine. The fuel system provides first and second conduits that draw fuel from first and second positions, or locations, within a fuel reservoir. If water exists in the fuel reservoir, the second position is selected to be lower in the fuel reservoir than the first position so that accumulated water will be drawn through the second conduit under certain conditions, such as when the engine is operating at a speed above the minimum threshold. The fuel reservoir can be a fuel tank or auxiliary fuel tank of a vehicle or watercraft or, alternatively, it can be the housing of a fuel/water separator.

U.S. Pat. No. 6,253,742 which issued to Wickman et al on Jul. 3, 2001, discloses a fuel supply method for a marine propulsion system. The method for controlling the operation of a fuel system of an outboard motor uses a lift pump to transfer fuel from a remote tank to a vapor separator tank. Only one level sensor is provided in the vapor separator tank and an engine control unit monitors the total fuel usage subsequent to the most recent filling of the tank. When the fuel usage indicates that the fuel level in the vapor separator tank has reached a predefined lower level, a lift pump is activated to draw fuel from a remote tank and provide that fuel to the vapor separator tank.

The patents described above are hereby expressly incorporated by reference in the description of the present invention.

In marine propulsion systems, and particularly in outboard motors, it is advantageous if components can be packaged in a way that reduces the required volume for the assembly of components. It is also advantageous if the components of a fuel delivery system for a marine propulsion system can be cooled in a way that prevents the vaporization of liquid fuel in response to heat being transmitted to the fuel components.

SUMMARY OF THE INVENTION

A fuel system for a marine propulsion system, made in accordance with the preferred embodiment of the present invention, comprises a reservoir having a cavity for containing liquid fuel for use by the marine propulsion system. It also comprises a first pump for drawing fuel from a fuel supply and pumping the fuel at a first pressure magnitude into the cavity. The first pump is disposed within the cavity and in thermal communication with the liquid fuel. The present invention further comprises a second pump for drawing the fuel from the cavity and pumping the fuel at a second pressure magnitude to an engine of the marine propulsion system. The second pump is disposed within the cavity and in thermal communication with the liquid fuel.

The present invention, in a preferred embodiment, further comprises a fuel tank that is connected as a fuel supply to an inlet of the first pump. A fuel filter is connected in fluid communication between the first tank and the first pump. The fuel filter can be a water separating fuel filter.

In certain embodiments of the present invention used in conjunction with fuel injected engines, the present invention further comprises a fuel rail connected in fluid communication with an outlet of the second pump. The fuel rail is connected in fluid communication with a plurality of fuel injectors which inject fuel either into a intake manifold of the engine or, in direct fuel injected (DFI) engines, directly into the combustion chambers of the engines.

A preferred embodiment of the present invention further comprises a fuel return line connected in fluid communication between an outlet of the fuel rail and the reservoir. A preferred embodiment of the present invention further comprises a pressure regulator connected between the outlet of the fuel rail and the reservoir in order to maintain a preselected pressure within the fuel rail. The pressure regulator is connected in fluid communication with an air intake manifold of the marine propulsion system in order to provide a reference pressure for the regulator. The preselected pressure within the fuel rail can be a preselected differential pressure magnitude above an air pressure within the air intake manifold of the engine.

The present invention can also comprise a fuel level sensor disposed within the reservoir to detect a fuel level within the reservoir. An engine control module (ECM) can be connected in signal communication with the first pump and in signal communication with the fuel reservoir, in order to turn the first pump on and off as a function of the level of liquid fuel within the reservoir.

In a preferred embodiment of the present invention, the first pressure magnitude is less than the second pressure magnitude and the marine propulsion system is an outboard motor. The reservoir, in one alternative embodiment of the present invention, is attached for support to a driveshaft housing of the outboard motor and, as a result of this location, the reservoir is at least partially submerged in water when a propeller of the marine propulsion system is not rotating.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
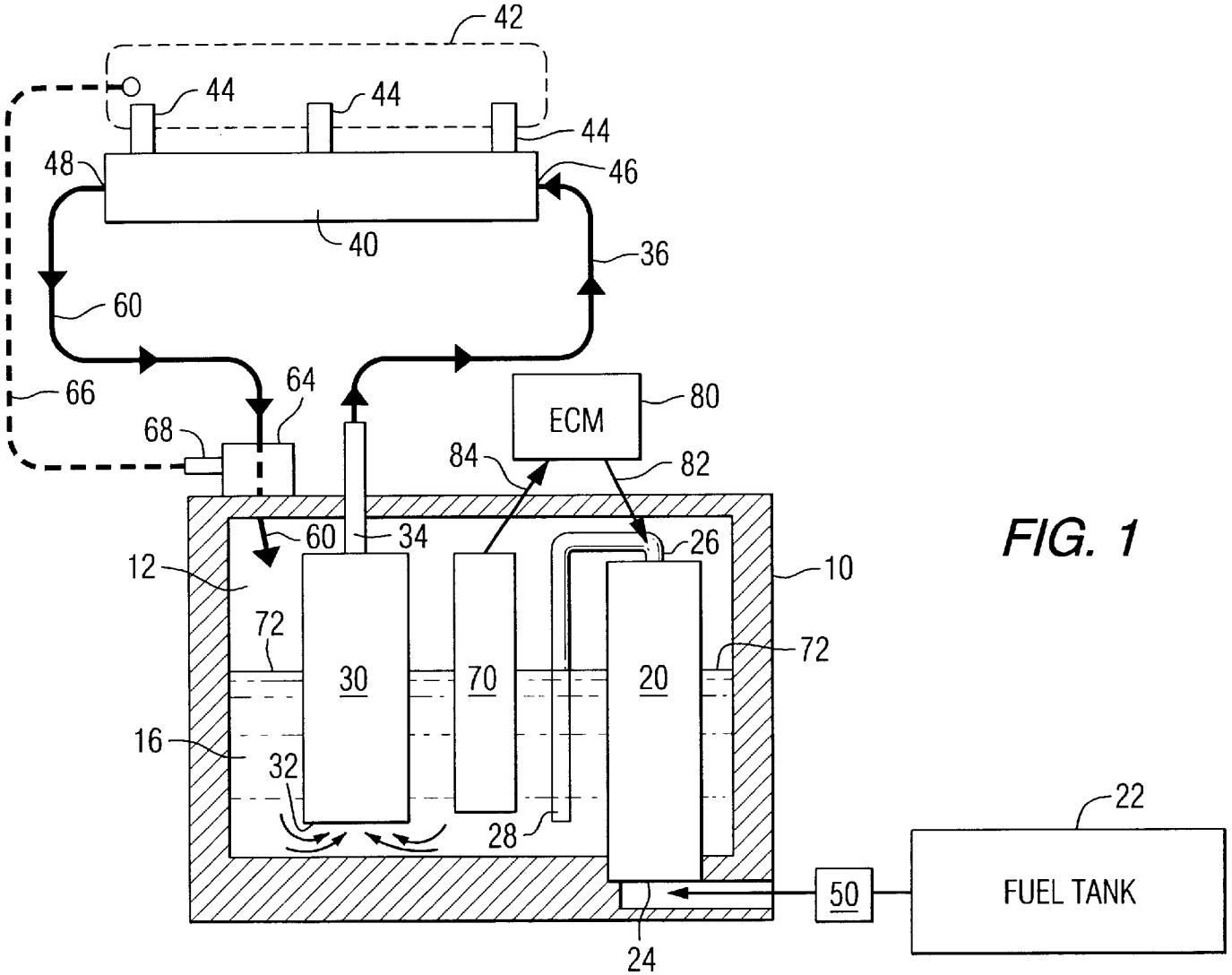
FIG. 1 is a schematic representation of a fuel system for a marine propulsion system made in accordance with the present invention.

Throughout the description of the preferred embodiment of the present invention, like components will be identified by like reference numerals.

In FIG. 1, the fuel system for a marine propulsion system, made in accordance with the preferred embodiment of the present invention, is represented schematically. A reservoir 10 encloses a cavity 12 for containing liquid fuel 16 for use by the marine propulsion system and, more particularly, for use by an engine of the marine propulsion system. A first pump 20 is provided for drawing fuel from a fuel supply, such as the fuel tank 22, and for pumping the fuel at a first pressure magnitude into the cavity 12. The fuel is drawn by the first pump 20 into its inlet 24 and pumped out of its outlet 26. In the embodiment shown in FIG. 1, a conduit 28 is provided to direct the fuel, at the first pressure magnitude, toward the bottom portion of the cavity 12.

A second pump 30 is provided for drawing fuel from the cavity 12 and pumping the fuel at a second pressure to an engine of the marine propulsion system. The engine is represented in FIG. 1 as the fuel rail 40 and an air intake manifold 42 which is represented by a dashed line. The fuel rail provides fuel to a plurality of fuel injectors 44 which inject fuel into the air intake manifold 42. Although the engine of a marine propulsion system comprises many other components, those components are not directly related to the present invention and are therefore not illustrated specifically in FIG. 1.

The liquid fuel is drawn into the inlet 32 of the second pump 30 and pumped out of the outlet 34, as represented by line 36 which can be a suitable conduit connected between the outlet of the second pump 30 and an inlet 46 of the fuel rail 40. As can be seen in FIG. 1, both the first and second pumps, 20 and 30, are disposed within the cavity 12 of the reservoir 10 and disposed in thermal communication with the fuel 16 when the liquid fuel is within the cavity 12. This relationship between the first and second pumps, 20 and 30, and the fuel 16 provides for thermal exchange between the pumps and the liquid fuel. In a preferred embodiment of the present invention both the first and second pumps, 20 and 30, are driven by electric motors. However, this is not a required characteristic of the pumps in all alternate embodiments.

With continued reference to FIG. 1, it can be seen that the fuel tank 22 is connected, as a fuel supply, to the inlet 24 of the first pump 20. A fuel filter 50 is shown connected in fluid communication between the fuel tank 22 and the first pump 20. This fuel filter 50 can be a water separating fuel filter in a preferred embodiment of the present invention.

The fuel rail 40 is connected in fluid communication with the outlet 34 of the second pump 30 and also in fluid communication with the plurality of fuel injectors 44, as illustrated schematically in FIG. 1. A fuel return line 60 is connected in fluid communication between an outlet 48 of the fuel rail 40 and the reservoir 10. More specifically, a pressure regulator 64 is connected between the outlet 48 of the fuel rail 40 and the reservoir 10 in order to maintain a preselected pressure within the fuel rail 40. The pressure regulator 64 can be connected in fluid communication with the air intake manifold 42 of the marine propulsion system and the preselected pressure provided within the fuel rail 40 can be a preselected differential pressure magnitude above the air pressure within the air intake manifold 42. Dashed line 66 represents the connection between the air intake manifold 42 and a reference pressure inlet 68 of the pressure regulator 64. As a result, the pressure regulator 64 maintains a pressure within the fuel rail 40 that is a preselected magnitude greater than the pressure in line 66. Excessive pressure, provided by the second pump 30, is relieved by allowing the fuel to flow back into the cavity 12 of the reservoir 10, as represented by arrow 60.

A preferred embodiment of the present invention also comprises a fuel level sensor 70 that is disposed within the reservoir 10 to detect a fuel level 72 within the cavity 12 of the reservoir 10. An engine control module (ECM) 80 is connected in signal communication with the first pump 20, as represented by line 82, and in signal communication with the fuel level sensor 70, as represented by line 84. In this way, the fuel level sensor 70 provides information on line 84 to the engine control module 80 which can represent the fact that the fuel level 72 has dropped below a preselected magnitude. When the engine control module 80 receives this signal, it provides a signal on line 82 to the first pump 20 to activate the first pump and draw more fuel from the fuel tank 22 and pump that fuel into the cavity 12 of the reservoir 10. In this way, the engine control module 80 can maintain the level 72 of liquid fuel 16 within a predetermined range.

With continued reference to FIG. 1, the first pressure magnitude at the outlet 26 of the first pump 20 is typically very low since it is intended to be used as a lift pump to draw fuel from a fuel tank to the reservoir and the second pressure magnitude at the outlet 34 of the second pump 30 is typically in the range of 30 PSI to 90 PSI, depending on the application and on the type of engine used.

Figure 2:
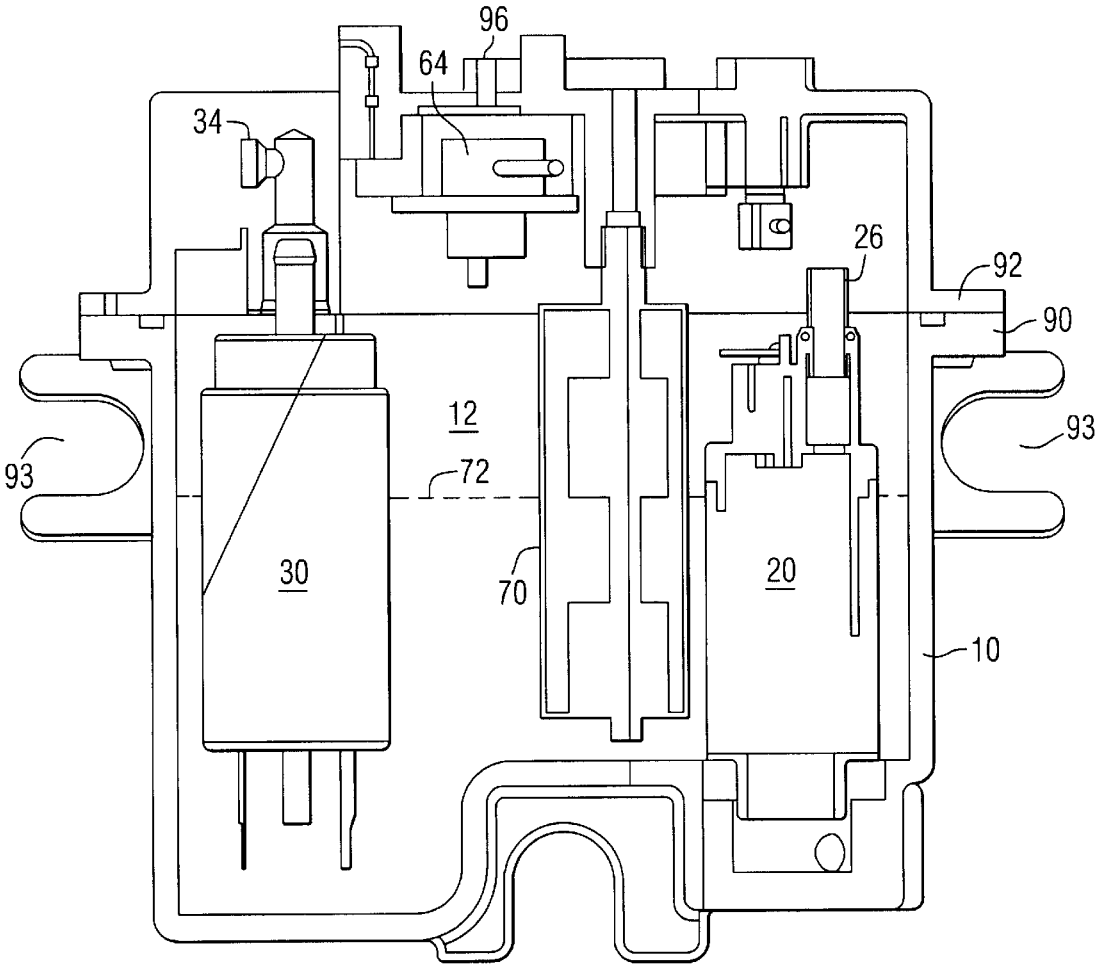
FIG. 2 is a section view of a reservoir of the present invention.

FIG. 2 is a section view of the reservoir 10 illustrated to show the components located within the cavity 12 of the reservoir 10. The first pump 20, the fuel level sensor 70 and the second pump 30 are all shown within the cavity 12 of the reservoir 10. In the representation of FIG. 2, the reservoir 10 comprises a lower portion 90 and an upper portion 92 that are bolted together to define the reservoir 10. The reservoir, in turn, is attached by a plurality of bolts, at location 93, to the marine propulsion system. In one embodiment of the present invention, which will be described in greater detail below in conjunction with FIG. 3, the reservoir 10 is attached to a driveshaft housing or mid portion of the leg of an outboard motor.

Also shown in FIG. 2 are the regulator 64, the outlet 34 of the second pump 30, the outlet 26 of the first pump 20, and a vent 96 which allows fuel vapor to escape from the ullage above the level 72 of the liquid fuel within the cavity 12 of the reservoir 10.

Figure 3:
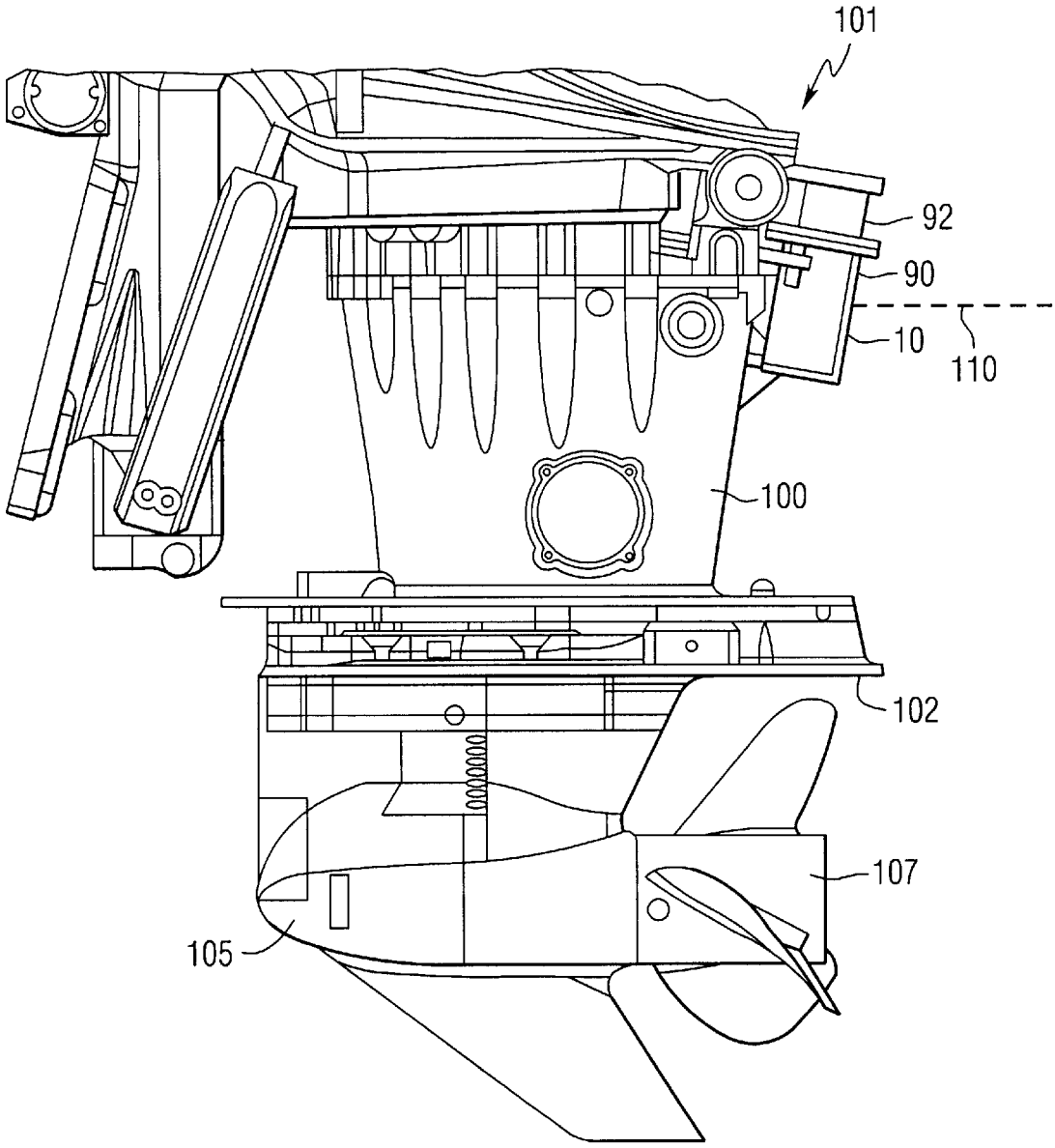
FIG. 3 shows the reservoir of the present invention mounted for support to a midsection of an outboard motor.

FIG. 3 shows a midsection 100 of an outboard motor with the reservoir 10 attached to it. Those skilled in the art of outboard motor design and manufacture are familiar with the overall structure of the midsection 100, or driveshaft housing, and the details will not be described herein. The anti-cavitation plate 102 is shown for reference at the bottom portion of the midsection 100. A driveshaft (not shown) extends downward in a vertical direction through the midsection 100 and connects the crankshaft of an engine located above the midsection 100 to a gear housing 105 and propeller shaft which are not shown in FIG. 3. The propeller 107 and gear housing (105) are illustrated in FIG. 3 to show that the gear housing 105 is supported at the bottom portion of the midsection 100, or driveshaft housing, and the gear housing 105, in turn, supports a propeller shaft to which a propeller 107 is attached. The internal portion of the midsection 100 also provides a conduit 110 for the downward transmission of exhaust gases from the engine to an outlet located in the gear housing 105.

With continued reference to FIG. 3, it can be appreciated that the location of the reservoir 10 on the midsection 100 at the position shown in FIG. 3 causes the reservoir 10 to be immersed in water when the propulsion system is not actively driving a marine vessel on plane. When the marine propulsion system is inactive and the marine vessel settles to a resting position on the water, the reservoir 10 is lowered to a position that disposes it at least partially under the surface of the body of water in which the marine vessel is operated. This serves to provide additional cooling to the liquid and vapors within the reservoir 10 and further prevent the vaporization of liquid fuel within the components of the fuel delivery system as a result of heat transferred to the fuel delivery system from the engine after water drains from the engine cooling system and heat begins to be conducted outwardly from the combustion chambers to surrounding components, including components of the fuel delivery system. This transfer of heat from the engine to the components of the fuel delivery system after the engine is turned off typically results in vaporization of the fuel and the situation referred to as "vapor lock". By immersing the reservoir 10 in the cooler water of a body of water when the marine vessel is stationary, this deleterious situation is avoided.

With reference to FIGS. 1–3, it can be seen that the present invention provides a reservoir 10 in which a first pump 20 and a second pump 30 are disposed in thermal communication with liquid fuel stored within the reservoir 10. Liquid fuel can be pumped from a fuel tank 22 into the reservoir 10 and from the cavity 12 of the reservoir 10 to an internal combustion engine of the marine propulsion system. Both the first and second pumps, 20 and 30, are disposed in thermal communication within the liquid fuel in order to moderate the temperature of the two pumps. In addition, when mounted on the driveshaft housing 100, or midsection, a further benefit can be achieved when the reservoir 10 is at least partially submerged in the water in which the marine vessel is operated when the marine propulsion unit is not actively propelling the marine vessel on plane. When the marine vessel stops its forward movement, it settles to a position that disposes the reservoir 10 in thermal communication with lake water or sea water and this action further reduces the temperature of the reservoir 10 and its contents, which include the liquid fuel 16, the first and second pumps, and the various conduits through which liquid fuel is pumped by the fuel system. The present invention provides advantages which include the compactness of its design, which reduces the volumetric space required for the components, and the additional temperature moderation provided to the components of the fuel system which reduces the likelihood that "vapor lock" will occur. When the marine vessel is not operating on plane, the reservoir 10 is naturally lowered to a position illustrated in FIG. 3 with respect to dashed line 110 which approximates the level of the body of water in which the marine vessel is operated.

Although the present invention has been described with particular detail to illustrate several embodiments of the present invention, it should be understood that alternate embodiments are also within its scope.

What is claimed is:

1. A fuel system for a marine vessel, comprising:

a marine propulsion system which is attachable to said marine vessel;

a reservoir having a cavity for containing liquid fuel for use by an engine of said marine propulsion system of said marine vessel, said reservoir being attached to said marine propulsion system at a location which at least partially submerges said reservoir within a body of water in which said marine propulsion system is operated when a propulsor of said marine propulsion system is inactive; and a first pump disposed in fluid communication with said liquid fuel within said cavity.

2. The fuel system of claim 1, wherein:

said first pump is disposed within said cavity and is operable to draw fuel from a fuel supply and pump said fuel at a first pressure magnitude into said cavity.

3. The fuel system of claim 2, further comprising:

a second pump for drawing said fuel from said cavity and pumping said fuel at a second pressure magnitude to said engine of said marine propulsion system, said second pump being disposed within said cavity, said first and second pumps being disposed in thermal communication with said fuel when said fuel is within said cavity.

4. The fuel system of claim 3, wherein:

said first pressure magnitude is less than said second pressure magnitude.

5. The fuel system of claim 3, further comprising:

a fuel rail connected in fluid communication with an outlet of said second pump, said fuel rail being connected in fluid communication with a plurality of fuel injectors.

6. The fuel system of claim 5, further comprising:

a fuel return line connected in fluid communication between an outlet of said fuel rail and said reservoir.

7. The fuel system of claim 5, further comprising:

a pressure regulator connected between said outlet of said fuel rail and said reservoir to maintain a preselected pressure within said fuel rail.

8. The fuel system of claim 7, wherein:

said pressure regulator is connected in fluid communication with a air intake manifold of said marine propulsion system and said preselected pressure is a preselected differential pressure magnitude above an air pressure within said air intake manifold.

9. The fuel system of claim 1, further comprising:

a fuel tank connected, as said fuel supply, to an inlet of said first pump.

10. The fuel system of claim 9, further comprising:

a fuel filter connected in fluid communication between said fuel tank and said first pump.

11. The fuel system of claim 1, further comprising:

a fuel level sensor disposed within said reservoir to detect a fuel level within said reservoir.

12. The fuel system of claim 11, further comprising:

an engine control module connected in signal communication with said first pump and in signal communication with said fuel level sensor.

13. The fuel system of claim 1, wherein:

said marine propulsion system is an outboard motor.

14. A fuel system for a marine propulsion system, comprising:

a reservoir having a cavity for containing liquid fuel for use by an engine of said marine propulsion system, said reservoir being attached to said marine propulsion system at a location which disposes an outer surface of said reservoir in thermal communication with a body of water in which said marine propulsion system is operating when a propulsor of said marine propulsion system is inactive; and a first pump disposed within said cavity and in fluid communication with said liquid fuel within said cavity, said first pump being operable to draw fuel from a fuel supply and pump said fuel at a first pressure magnitude into said cavity.

15. The fuel system of claim 14, further comprising:

a second pump for drawing said fuel from said cavity and pumping said fuel at a second pressure magnitude to said engine of said marine propulsion system, said second pump being disposed within said cavity, said first and second pumps being disposed in thermal communication with said fuel when said fuel is within said cavity; and a fuel tank connected, as said fuel supply, to an inlet of said first pump.

16. The fuel system of claim 15, further comprising:

a fuel filter connected in fluid communication between said fuel tank and said first pump.

17. The fuel system of claim 16, further comprising:

a fuel rail connected in fluid communication with an outlet of said second pump, said fuel rail being connected in fluid communication with a plurality of fuel injectors.

18. The fuel system of claim 17, further comprising:

a fuel return line connected in fluid communication between an outlet of said fuel rail and said reservoir; and a pressure regulator connected between said outlet of said fuel rail and said reservoir to maintain a preselected pressure within said fuel rail, said pressure regulator being connected in fluid communication with a air intake manifold of said marine propulsion system and said preselected pressure is a preselected differential pressure magnitude above an air pressure within said air intake manifold.

19. A fuel system for an outboard motor having a drive shaft and a propulsor, comprising:

a reservoir having a cavity for containing liquid fuel for use by an engine of said outboard motor, said reservoir being attached to a housing of said drive shaft at a location which disposes said reservoir in thermal communication with water in which said outboard motor is operated when said propulsor of said outboard motor is inactive; and a first pump disposed in fluid communication with said liquid fuel within said cavity.

20. The fuel system of claim 19, further comprising:

a second pump for drawing said fuel from said cavity and pumping said fuel at a second pressure magnitude to said engine of said outboard motor, said second pump being disposed within said cavity, said first and second pumps being disposed in thermal communication with said fuel when said fuel is within said cavity, said first pump being disposed within said cavity and is operable to draw fuel from a fuel supply and pump said fuel at a first pressure magnitude into said cavity;

a fuel tank connected, as said fuel supply, to an inlet of said first pump;

a fuel filter connected in fluid communication between said fuel tank and said first pump;

a fuel rail connected in fluid communication with an outlet of said second pump, said fuel rail being connected in fluid communication with a plurality of fuel injectors;

a fuel return line connected in fluid communication between an outlet of said fuel rail and said reservoir;

a pressure regulator connected between said outlet of said fuel rail and said reservoir to maintain a preselected pressure within said fuel rail, said pressure regulator being connected in fluid communication with a air intake manifold of said outboard motor and said preselected pressure is a preselected differential pressure magnitude above an air pressure within said air intake manifold;

a fuel level sensor disposed within said reservoir to detect a fuel level within said reservoir; and an engine control module connected in signal communication with said first pump and in signal communication with said fuel level sensor, said first pressure magnitude being less than said second pressure magnitude.

* * * * *